United States Patent [19]

Morioka et al.

[11] Patent Number: 5,028,033

[45] Date of Patent: Jul. 2, 1991

[54] PROCESS FOR DETECTING OUTFLOW OF SLAG

[75] Inventors: Nobuhiko Morioka; Kazuhisa Hamagami; Shigeru Ogura, all of Chiba, Japan

[73] Assignee: Kawasaki Steel Corporation, Japan

[21] Appl. No.: 415,346

[22] PCT Filed: Mar. 8, 1989

[86] PCT No.: PCT/JP89/00252

§ 371 Date: Sep. 7, 1989

§ 102(e) Date: Sep. 7, 1989

[87] PCT Pub. No.: WO89/08719

PCT Pub. Date: Sep. 21, 1989

[30] Foreign Application Priority Data

Mar. 9, 1988 [JP] Japan ..... 63-53575
Aug. 11, 1988 [JP] Japan ..... 63-198913

[51] Int. Cl.[5] ..... C21B 7/12

[52] U.S. Cl. ..... 266/45; 222/603; 222/590; 266/78

[58] Field of Search ..... 266/45, 236, 78; 222/590, 591, 603

[56] References Cited

FOREIGN PATENT DOCUMENTS

| | | |
|---|---|---|
| 53-53521 | 5/1978 | Japan . |
| 57-112963 | 7/1982 | Japan . |
| 57-79109 | 8/1982 | Japan . |
| 58-31021 | 2/1983 | Japan . |
| 58-025413 | 4/1983 | Japan . |
| 60-3955 | 1/1985 | Japan . |
| 60-3956 | 1/1985 | Japan . |
| 61-262454 | 1/1986 | Japan . |
| 61-30615 | 2/1986 | Japan . |
| 61-210114 | 2/1987 | Japan . |

*Primary Examiner*—S. Kastler
*Attorney, Agent, or Firm*—Austin R. Miller

[57] ABSTRACT

A method is disclosed for accurately detecting an outflow of a slag into a stream of a molten steel when the molten steel is poured from a first vessel such as a refining furnace or a ladle into an intermediate vessel such as a ladle or a tundish through a melt-discharging hole or a nozzle. At that time, an inert gas is fed into the stream of the molten steel in the nozzle through a side portion of the melt-discharging hole or the nozzle, and the detection is made based on a change in a flow rate of the inert gas sucked into the stream of the molten steel and/or in a back pressure.

2 Claims, 5 Drawing Sheets

PROCESS FOR DETECTING OUTFLOW OF SLAG

TECHNICAL FIELD

The present invention relates to a process for detecting outflow of slag with high accuracy on pouring a molten steel.

TECHNICAL BACKGROUND

Slag is ordinarily likely to flow out into a stream of a molten steel in a final stage of discharging the molten steel from a refining furnace such as a converter to a ladle through a molten steel-discharging opening, or in a final stage of pouring the molten steel from a ladle to an intermediate vessel such as a tundish through a nozzle.

If the slag is discharged into the molten steel, alloying components such as Al, Fe-Mn and Fe-Si added thereto are taken into the slag, and production cost rises due to reduction in yields of such alloying components. Further, since the molten steel is oxidized with the slag discharged, cleanness of the steel is deteriorated, so that the quality of steel products is adversely affected. For this reason, it is an extremely important control item to suppress the outflow of the slag into the molten steel to the minimum, and various countermeasures have formerly been adapted for this purpose.

As the conventional techniques for detecting the outflow of the slag into the molten steel stream, visually judging is a main technique. As methods for detecting the slag entering the stream extracted, particularly, from the ladle to the tundish, for instance, Japanese Patent Application Laid-open No. 57-112,963 discloses a process for measuring vibrations, Japanese Patent Application Laid-open No. 53-53,521 discloses a process for measuring the impedance, Japanese Patent Application Laid-open Nos. 60-3,955 and 60-3,956 disclose a process for measuring microwaves, and Japanese Patent Application Laid open No. 61-262,454 discloses a process for measuring the internal pressure of a nozzle.

However, the above-mentioned conventional techniques have the following problems.

That is, the above visual judgment lacks accuracy, because variations occur due to individual differences among judging persons. The judgment needs longer time, and it is impossible to make any such judgment in the case where a poured molten steel as in a sealed type tundish is not observable from the outside.

The vibration-measuring process, the impedance-measuring process, and the microwave-measuring process require that a measuring sensor is caused to approach the extracted stream. Thus, problems exist with respect to maintenance or operability. Furthermore, the apparatus disadvantageously becomes great size, and costly.

In the nozzle internal pressure-measuring process, a pressure-measuring hole is liable to be closed with the molten steel or the slag on measuring a negative pressure inside a long nozzle. Thus, the pressure cannot be detected in many cases. Moreover, since the change of pressure inside the nozzle is as extremely small as about 0.02 kgf/cm$^2$ when the poured melt stream is changed from the molten steel to the slag, it is difficult to accurately detect the change. In addition, since the pressure loss is great depending upon the shape of the pressure-measuring hole, it may become impossible to detect the pressure change due to the slag discharging. Thus, the pressure cannot accurately be detected. Furthermore, the internal pressure of the nozzle detected by this method is measured by press fitting a long nozzle to a nozzle of the ladle, purging the inside of the nozzle through blowing an inert gas upon a press-fitted portion via an inert gas-blowing pipe, and measuring the static pressure (negative pressure) inside the nozzle. Although the inclusion amount of the inert gas into the molten steel stream differs from the inclusion amount of the inert gas owing to the discharging slag (the amount of the gas sucked through the press-fitted portion), the inert gas is sucked through the press-fitted portion so that the internal pressure may be constant irrespective of the flow-down kinetic energy of the flowing material. Therefore, since the internal pressure inside the nozzle is maintained at almost the same level, this process has a shortcoming in that the discharging of the slag cannot stably or accurately be detected.

DISCLOSURE OF THE INVENTION

It is an object of the present invention to advantageously overcome the above-mentioned problems, and to propose a process capable of stably detecting outflow of the slag into the molten steel stream with high accuracy.

That is, the present invention relates to a process for detecting outflow of the slag by supplying an inert gas into the molten steel stream in the supply pipe through a gas feed hole formed in a side of the pipe and judging whether or not the slag enters the stream of the molten steel based on changes in flow rate of an inert gas sucked into the molten steel stream and/or changes in back pressure, when the molten steel having undergone refining is poured from a first vessel for holding the molten steel to a second vessel through a feed pipe.

In the present invention, the first vessel means a refining furnace such as a converter, and the second vessel is an intermediate vessel such as a tundish. The feed pipe means a steel-discharging hole or a nozzle. Accordingly, molten steel-pouring systems to which the process of the present invention is applicable include a case where the molten steel is poured from the ladle into the tundish through the nozzle.

In the following, the present invention will concretely be explained with reference to the attached drawings.

BRIEF DESCRIPTION OF THE DRAWINGS

FIG. 1 is a diagrammatical view showing a preferable control system for effecting the process of the present invention, which illustrates a case where flowing out of slag is detected when molten steel is poured from a ladle to a tundish in continuous steel casting.

In FIG. 1, reference numerals 1 and 2 are the ladle and a ladle nozzle fitted to a bottom of the ladle, respectively. A reference numeral 3 is the tundish into which the molten steel 5 held in the ladle 1 is poured through a long nozzle 4. The slag 6 floats on the upper surface of the molten steel 5.

Figure 1:
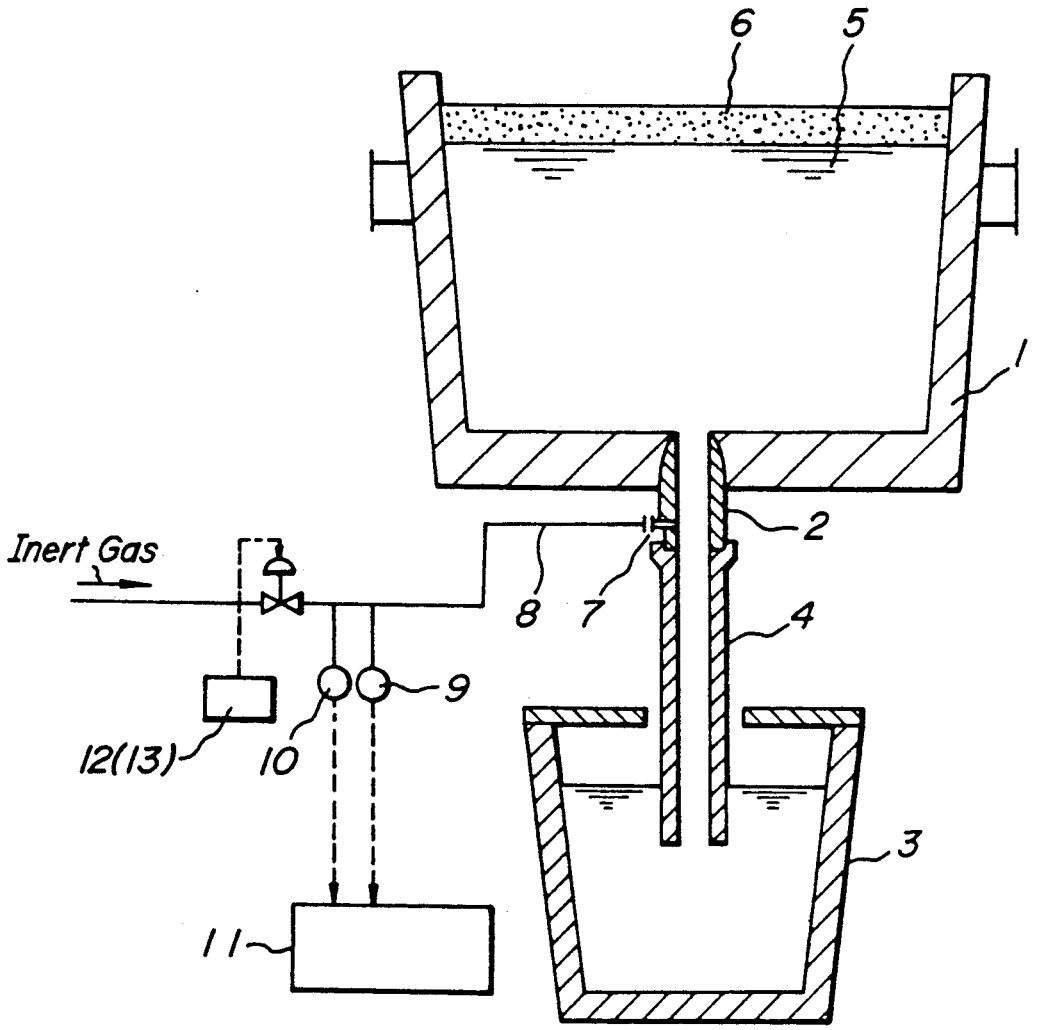
FIG. 1 is a schematic view of a preferred control system for use in effecting the invention process.

A reference numeral 7 shows a gas supply hole provided through a side face of the ladle nozzle 2. An inert gas is fed through the gas supply pipe 8.

Reference numerals 9 and 10 are a flow meter, and a pressure gauge, respectively, which are both attached to the gas supply pipe 8. Measurement signals are fed to a slag detector 11 from them. As the case may be, it may be that a constant pressure controller 13 is provided for the gas supply pipe 8.

The slag outflow detector of FIG. 1 is constituted and operates as follows: When the molten steel 5 in the ladle 1 is to be poured into a tundish 3, the inert gas is supplied to the ladle nozzle 2 through the gas supply hole 7. At that time, whether the slag flows out into a stream of the molten steel or not is judged by detecting reduction in the flow rate of the inert gas sucked into the stream of the molten steel inside the nozzle.

Depending upon judgment results, the outflow of the slag into the tundish can effectively be controlled by stopping the pouring of the molten steel from the ladle through operating a stopper or a sliding nozzle not shown.

Since the molten steel needs to be prevented to the utmost from being oxidized again, the inert gas used is preferably, for instance, Ar gas.

The gas supply hole 7 may be provided at a peripheral side of the long nozzle 5.

The combination of the ladle 1 with the tundish 3 has been explained in the above construction. However, when a refining furnace such as a converter is combined with a ladle, a gas supply hole 7 is provided in a steel discharge hole of the refining furnace.

Next, the principle of the process for detecting the outflow of the slag according to the present invention will be explained below.

In general, the principle of the invention is like a water stream blown through a nozzle and mixed with a medium to be driven at a throat in the case of a water-ejecting pump, and its kinetic energy is given to the medium. Then, a speed head is converted to a pressure head by a diffuser to produce suction forces.

As is the same as this principle, suction forces are generated in a gas flow hole provided in the pipe (for instance, a steel discharge hole, a ladle nozzle, a long nozzle or the like), when the molten steel stream passes inside the pipe.

The magnitude of suction forces varies depending upon the diameter and the shape of the gas flow path or the pipe, and is greatly influenced by the kinetic energy of the discharging stream. Therefore, since there is a density difference between the molten steel stream and the slag stream, their suction forces naturally differ.

Thus, as shown in FIG. 1, when the molten steel 5 is poured from the ladle nozzle 2, inert gas is fed through the gas feed opening 7, reduction in the flow rate of the inert gas sucked into the molten steel stream and/or increase in the back pressure are individually or simultaneously measured. Thereby, the outflow rate of the slag into the molten steel stream can be detected based on changes in the flow rate and the back pressure, that is, changes in the suction forces.

Here, the magnitude of the kinetic energy of the poured melt stream depends upon the head level of the molten steel 5 inside the ladle 1, the open area of the ladle nozzle 2, and the density of the poured molten steel stream.

Therefore, when the content of the poured stream changes from the molten steel to the slag, the density of the poured stream greatly changes. While the density of the molten steel is about 7,000 kg/cm$^3$, that of the slag is about 2,500 kg/cm$^3$. Accordingly, the kinetic energy of the poured stream also greatly changes.

To the contrary, when the inert gas is fed into the ladle nozzle 2, the gas fed is caught into the outgoing melt stream by the kinetic energy possessed by it. The inert gas inside the gas supply hole 7 and further inside the gas feed pipe 8 are sucked into the ladle nozzle 2. Since the suction forces depend upon the kinetic energy possessed by the poured melt stream at that time, the suction forces greatly change when the content of the poured melt stream changes from the molten steel to the slag. Therefore, the outflow of the slag can be detected by continuously measuring the flow rate and/or the back pressure of the inert gas flowing inside the gas supply pipe 8.

Figure 2:
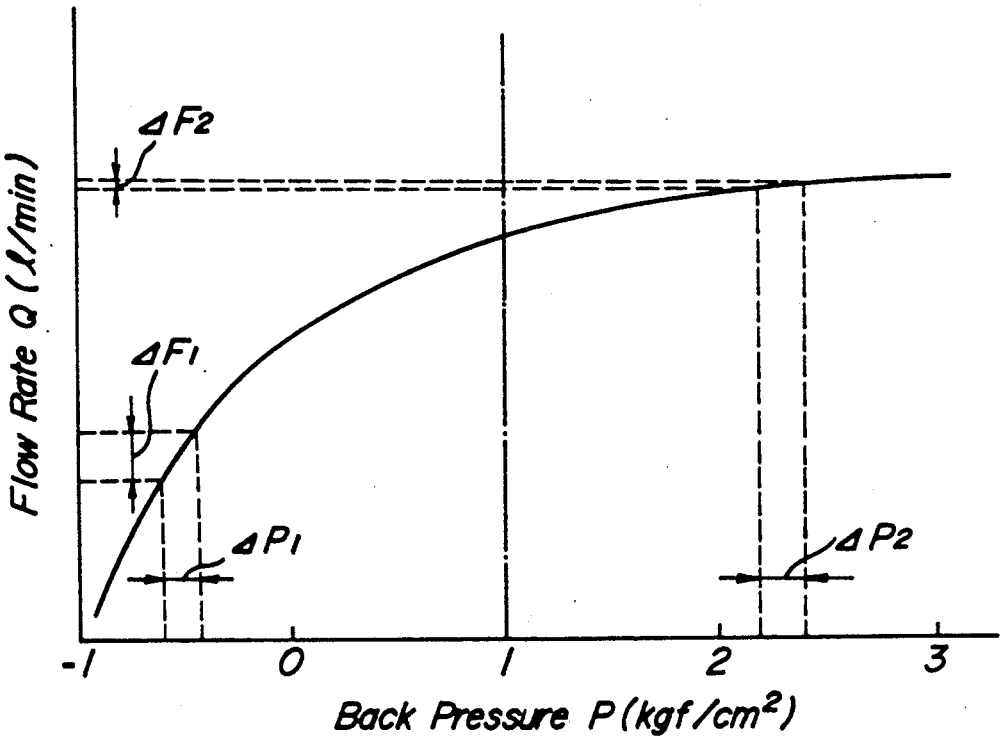
FIG. 2 is a diagram showing the relationship between the back pressure and the flow rate of the gas sucked when the inert gas is fed.

FIG. 2 is a diagram showing the relationship between the back pressure and the flow rate of the inert gas sucked when the inert gas is fed into the ladle nozzle 2 through the gas supply hole 7. It is seen that the relationship is $Q \simeq \sqrt{P+1}$, in which P and Q denote the back pressure (kgf/cm$^2$) and the flow rate (l/min), respectively.

As is understood from this figure, when the back pressure P of the inert gas fed is not more than 1 kgf/cm$^2$ as the atmospheric pressure, the flow rate greatly changes by $\Delta F_1$ for a slight change $\Delta P_1$ in the back pressure. Therefore, it is preferable to measure the flow rate Q in this case. On the other hand, when the back pressure P is more than 1 kgf/cm$^2$, the flow rate Q slightly changes by $\Delta F_2$ even when the back pressure changes by as much as $\Delta P_2$. Thus, the back pressure P is detected in this case. It is possible to enhance the measuring accuracy when measurement is effected while the flow rate Q and the back pressure P are related together.

When the back pressure P of the fed gas is kept constant by attaching the pressure-maintaining unit 12, reduction in the flow rate Q becomes greater when the slag flows out, and thus the detecting accuracy increases. Further, when the constant flow rate-maintaining means 13 is used, the degree of increase in the back pressure P can be made larger.

As mentioned above, according to the slag-detecting process of the present invention, since the inert gas is positively fed into the discharging stream through the gas supply hole 7, a problem formerly seen, in that the gas flow path becomes clogged with the metal, will not occur at all, and the outflow of the slag can accurately be detected.

BEST MODE FOR EFFECTING THE INVENTION

Figure 3A:
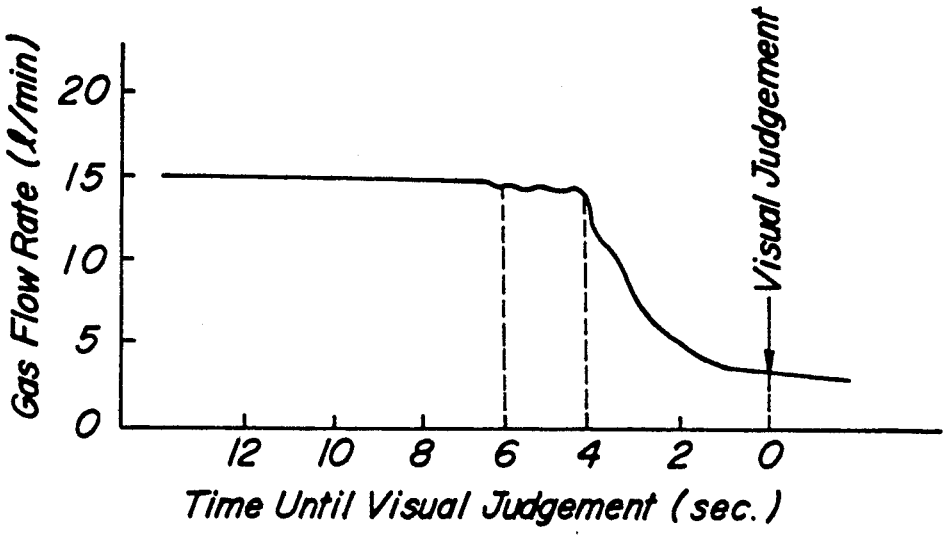
FIGS. 3*a* and 3*b* are diagrams illustrating changes in the flow rate and the back pressure of Ar gas in a final pouring stage.
Figure 3B:
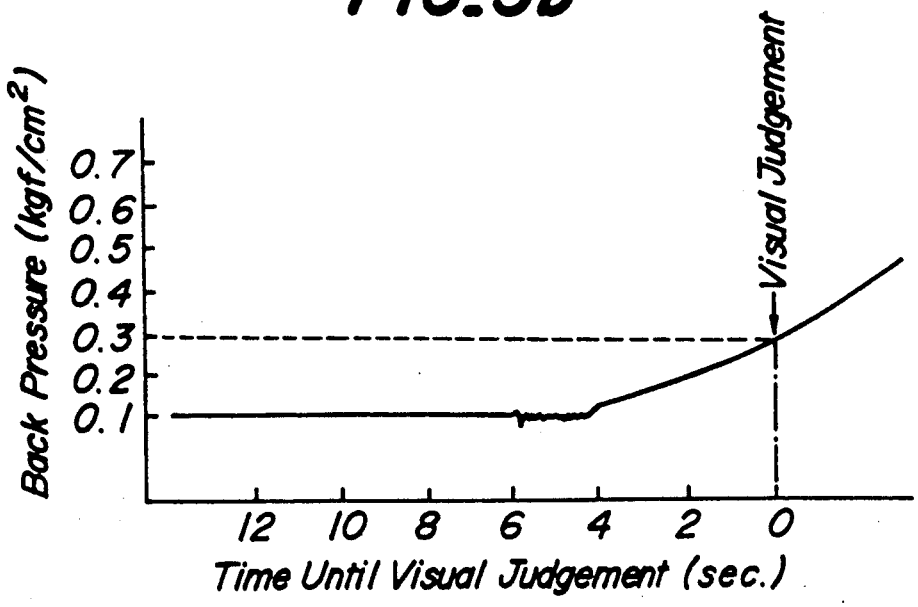

While Ar gas was fed into a ladle nozzle at a flow rate of 15 l/min under a back pressure of 0.1 kgf/cm$^2$, molten steel was poured from a ladle having a volume of 230 tons to a tundish by using a long nozzle. Changes in the flow rate and the back pressures at that time were measured. Their measurement results in a pouring final stage is shown in FIGS. 3*a* and 3*b*, respectively. Judgments were also visually effected at the same time.

As shown in FIG. 3*a*, the flow rate of Ar gas began to change 6 seconds before the visual judgment, and changed to 13 l/min 4 seconds before the visual judgment. Thereafter, the flow rate was conspicuously lowered to reach 3 l/min at the time of the visual judgment.

On the other hand, as shown in FIG. 3*b*, the back pressure was 0.1 kgf/cm$^2$ with respect to the atmospheric pressure 4 seconds before the visual judgment, and increased to 0.3 kgf/cm$^2$ at the time of the visual judgment.

From this, it can be judged that slag began to flow out at the point of time when the Ar gas flow rate became smaller by 2 l/min than the initial flow rate, that is, 4 seconds before the visual judgment.

Therefore, if the pouring of the molten steel from the ladle is stopped at this point of time by operating a stopper or a sliding nozzle for the ladle, outflow of the slag can greatly be reduced. The judgment criterion of the outflow of the slag may appropriately be set depending upon operation conditions.

Next, the clogged state of the tundish was examined by using the above slag outflow-detecting process. Results are shown in FIG. 4.

In this figure, the abscissa shows the amount (kg) of the ladle slag entering the tundish from the ladle per one charge, and the ordinate shows the increase (cm$^2$.min/-ton) in the clogged index of the tundish nozzle. The clogged index of the tundish is an open area of the nozzle capable of feeding 1 ton of the molten steel per one minute. The greater the clogged index, the more conspicuous the clogging of the nozzle.

Figure 4:
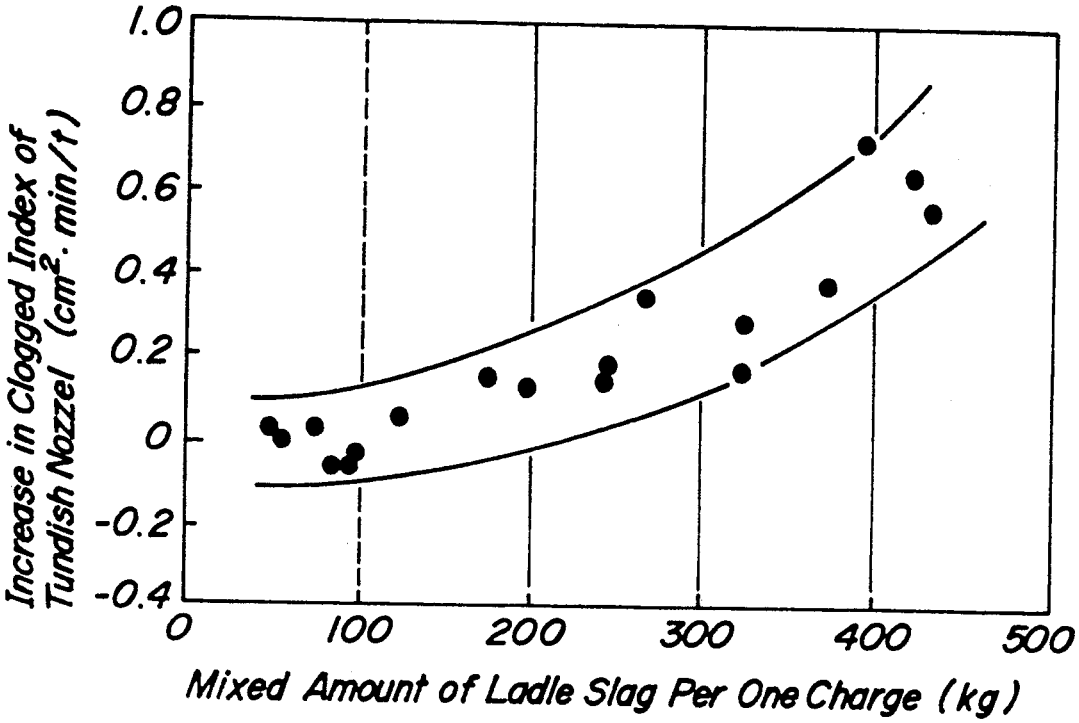
FIG. 4 is a diagram showing the relationship between the mixed amount of slag in the ladle and the increase in the clogged index of the nozzle for the tundish.

As is clear from FIG. 4, the smaller the amount of ladle slag entering the tundish from the ladle, the smaller the nozzle-clogged index. Particularly, when the mixed amount of the slag from the ladle is not more than 100 kg, the nozzle-clogged index is almost zero. Therefore, when the mixed amount of the slag from ladle is set at not more than 100 kg, the molten steel can continuously be poured without suffering clogging of the slag.

Figure 5:
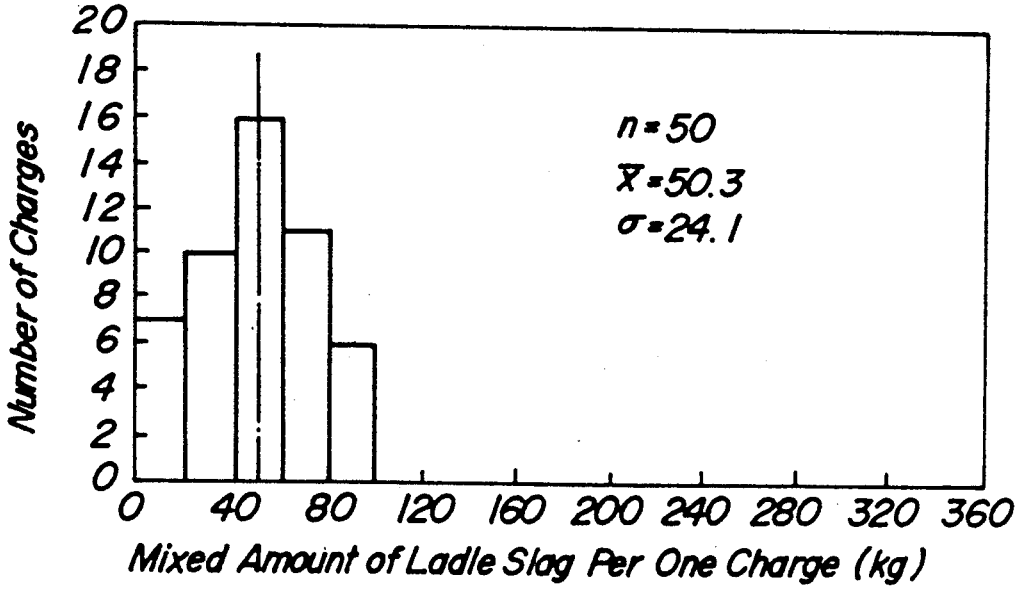
FIG. 5 is a characteristic view showing the distribution of the mixed amount of the slag in the ladle when the melt is poured into the tundish according to the invention process.

FIG. 5 is a characteristic diagram showing the distribution of the mixed amount of the slag from the ladle when the molten steel was poured into the tundish according to the process of the present invention. At that time, the number of charges of the melt, "n", was 50 charges. The average mixed amount "X" of the slag from the ladle was 50.3 kg per one charge, and the standard deviation "$\sigma$" was 24.1 kg.

Figure 6:
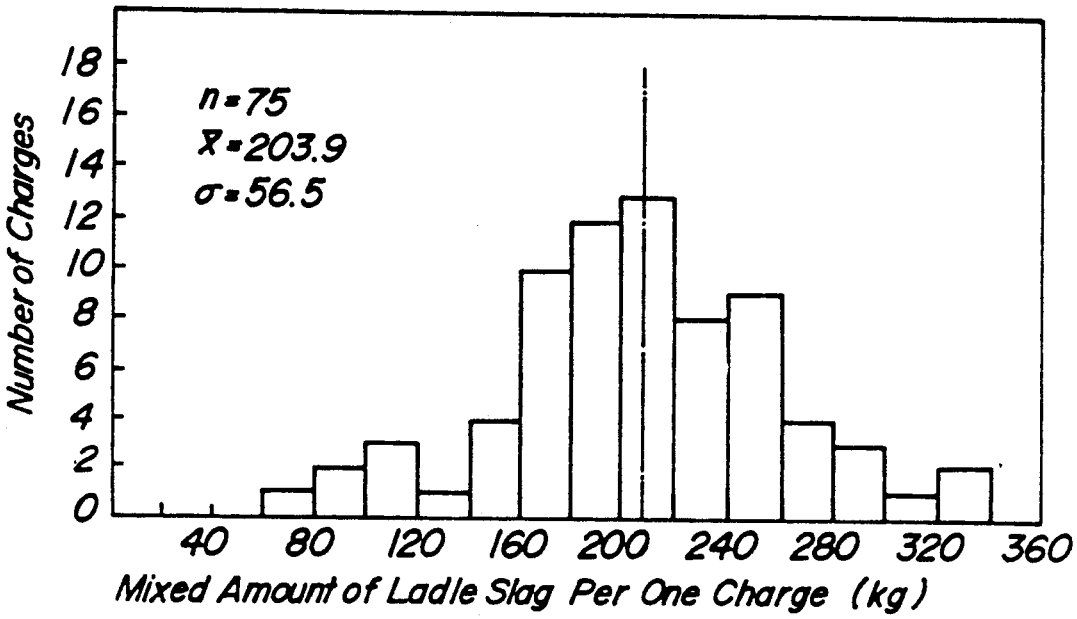
FIG. 6 is a characteristic view illustrating the distribution of the mixed amount of the slag in the ladle when the melt is poured into the tundish.

For comparison purpose, FIG. 6 shows the distribution of the mixed amount of the slag from the ladle according to a conventional process. At that time, the number of charges of the melt, "n", was 75 charges. The average mixed amount "X" of the slag from the ladle was 203.9 kg, and the standard deviation "$\sigma$" was 56.5 kg.

As is clear from the above results, the mixed amount of slag from the ladle was reduced to about one third of that in the conventional case by using the invention process.

Figure 7:
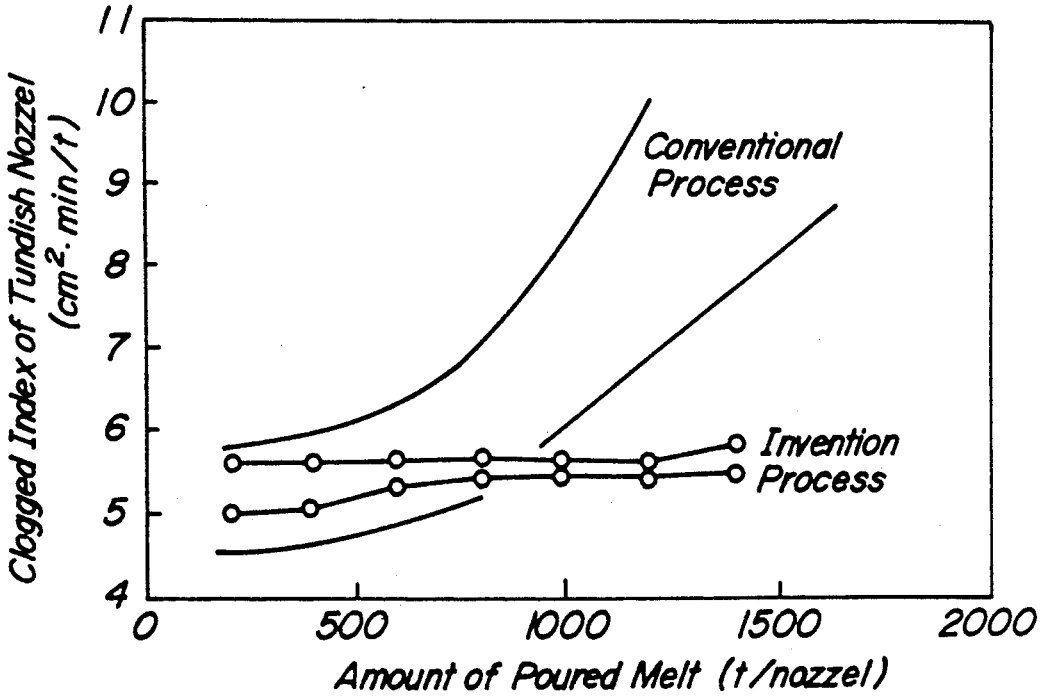
FIG. 7 is a diagram illustrating the relationship between the amount of the poured melt and the nozzle-clogged index per tundish nozzle.

FIG. 7 is a characteristic diagram showing the relationship between the amount of the melt poured per one tundish nozzle and the nozzle-clogged index.

As is understood from FIG. 7, the nozzle-clogged index increased with the increases in the poured amount of the melt. Particularly, when it was 500 ton/nozzle or more the clogged degree of the nozzle became conspicuous. To the contrary, when the process according to the present invention was employed, almost no clogging of the nozzle was recognized even with increase in the poured amount of the melt.

From the above, it is seen that according to the present invention in which the amount of slag entering the tundish through the nozzle is suppressed to not more than 100 kg per one charge, the melt can continuously be poured at 500 tons/nozzle without clogging the nozzle.

INDUSTRIAL APPLICABILITY

According to the present invention, since the outflow of the slag from the ladle can be detected at an early stage, the amount of slag flowing out into the tundish can be reduced, and the following effects can be obtained.

1. Yield of Al or an alloyed iron such as Fe-Mn or Fe Si added into the ladle is increased.
2. Since the amount of the molten steel oxidized again with the slag can be reduced, cleanness of the molten steel can be improved.
3. The cost of a refractory material can be reduced by increasing the amount of the molten steel continuously poured per one nozzle.
4. Since the clogging of the nozzle can be prevented, the molten steel can continuously be poured at a high efficiency.

We claim:

1. A method for detecting the presence or absence of outflow of slag when a refined molten steel having slag floating thereon in a vessel is poured out of said vessel and into another vessel through a feed pipe in a closed pouring system wherein an inert gas is fed through suction into a stream of the molten steel in the feed pipe through a gas feed hole provided in the feed pipe, and whether the slag has entered the stream in the feed pipe or not is determined by detecting the reduction in flow rate of the inert gas sucked into the molten stream and increase of back pressure of said inert gas.

2. A method for detecting the presence of outflow of slag when a refined molten steel having slag floating thereon in a vessel is poured out of said vessel and into another vessel through a feed pipe in a closed pouring system wherein an inert gas is fed through suction into a stream of the molten steel in the feed pipe through a gas feed hole provided in the feed pipe, and whether the slag has entered the stream in the feed pipe or not is determined by detecting the reduction in flow rate of the inert gas sucked into the molten stream or increase of back pressure of said inert gas.

* * * * *